US009756959B2

(12) United States Patent
Kozel et al.

(10) Patent No.: US 9,756,959 B2
(45) Date of Patent: Sep. 12, 2017

(54) SYSTEMS AND METHODS FOR MATTRESS ASSEMBLIES WITH ATTACHED CUSTOMER ASSISTANCE SENSORY DEVICES

(75) Inventors: Anne Kozel, Atlanta, GA (US); Mark Owen, Newnan, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 678 days.

(21) Appl. No.: 12/624,634

(22) Filed: Nov. 24, 2009

(65) Prior Publication Data

US 2010/0132231 A1 Jun. 3, 2010

Related U.S. Application Data

(60) Provisional application No. 61/200,457, filed on Nov. 26, 2008.

(51) Int. Cl.

| | |
|---|---|
| ***A47C 31/12*** | (2006.01) |
| ***G09F 27/00*** | (2006.01) |
| ***A47C 21/00*** | (2006.01) |
| ***G09F 23/00*** | (2006.01) |

(52) U.S. Cl.

CPC ..... *A47C 31/123* (2013.01); *A47C 21/003* (2013.01); *G09F 23/00* (2013.01); *G09F 27/00* (2013.01); *Y10T 29/49826* (2015.01)

(58) Field of Classification Search

CPC ... A47C 19/022; A47C 27/146; A47C 19/021; A47C 31/123; A47C 21/003; A61G 7/05; G09F 27/00; G09F 23/00; Y10T 29/49826

USPC ... 5/690, 706, 709, 716, 718, 53.1, 737, 738

See application file for complete search history.

(56) References Cited

U.S. PATENT DOCUMENTS

| | | | | |
|---|---|---|---|---|
| 2,223,433 | A | 12/1940 | Sternberg | |
| 4,788,729 | A * | 12/1988 | Walker | 5/711 |
| 4,803,744 | A * | 2/1989 | Peck et al. | 5/713 |
| 5,484,195 | A * | 1/1996 | O'Donnell | 312/125 |
| 5,499,407 | A * | 3/1996 | Atwell et al. | 5/1 |
| 6,263,816 | B1 * | 7/2001 | Codos et al. | 112/475.08 |
| 6,375,144 | B1 * | 4/2002 | Lacey | 248/441.1 |

(Continued)

FOREIGN PATENT DOCUMENTS

| | | |
|---|---|---|
| JP | 2007 236756 A | 9/2007 |
| WO | WO-2007/008830 A2 | 1/2007 |

OTHER PUBLICATIONS

"Explanation of Sensus Memory Foam Compared to TempurPedic", Mar. 2008, https://www.youtube.com/watch?v=qhHHk0ChoF0.*

(Continued)

*Primary Examiner* — Eric Kurilla

(74) *Attorney, Agent, or Firm* — Cantor Colburn LLP

(57) ABSTRACT

In many aspects, the systems and methods described herein include mattress assemblies with attached sensory devices. The mattress assembly comprises a mattress core, an attached headboard, a mattress cover at least partially enclosing the mattress core, and at least one customer assistance sensory device attached to at least one of the core, headboard, and cover. The customer assistance sensory device is configured to present at least one parameter of the mattress core or assembly as at least a visual signal. Visual signals may include one or more distinct colors, shapes, or graphic patterns that correspond to one or more parameter of the mattress core or assembly.

11 Claims, 4 Drawing Sheets

(56) References Cited

U.S. PATENT DOCUMENTS

| | | | | |
|---|---|---|---|---|
| 6,845,532 | B1 | 1/2005 | Rosenblum | |
| 6,952,851 | B1 * | 10/2005 | Mahoney | 5/690 |
| 6,971,133 | B2 * | 12/2005 | See | 5/706 |
| 7,771,375 | B2 * | 8/2010 | Nishibori et al. | 601/47 |
| 8,296,976 | B2 * | 10/2012 | Murphy et al. | 40/320 |
| 2003/0029062 | A1 * | 2/2003 | Esterman | G09F 3/10 40/5 |
| 2003/0118795 | A1 * | 6/2003 | Wright | A47C 27/00 428/195.1 |
| 2004/0068882 | A1 * | 4/2004 | Nennig | 33/562 |
| 2004/0073931 | A1 * | 4/2004 | Trussell et al. | 725/74 |
| 2005/0034241 | A1 * | 2/2005 | Prince | A47D 15/001 5/690 |
| 2006/0075550 | A1 * | 4/2006 | Hanson | 5/53.1 |
| 2007/0017033 | A1 * | 1/2007 | Antinori | 5/716 |
| 2007/0160320 | A1 * | 7/2007 | McGuire et al. | 385/15 |
| 2007/0283501 | A1 * | 12/2007 | Mossbeck | 5/727 |
| 2008/0086814 | A1 * | 4/2008 | Wootten | 5/499 |
| 2008/0093784 | A1 * | 4/2008 | Rawls-Meehan | 267/80 |
| 2008/0098533 | A1 * | 5/2008 | Erdman | 5/722 |
| 2008/0154670 | A1 * | 6/2008 | McAlhaney | 705/7 |
| 2008/0201856 | A1 * | 8/2008 | Howard | A47C 27/001 5/690 |
| 2008/0301983 | A1 * | 12/2008 | Murphy et al. | 40/360 |
| 2009/0171774 | A1 * | 7/2009 | Stagner | G06Q 30/0242 705/14.41 |
| 2009/0171864 | A1 * | 7/2009 | Stagner | G06Q 30/0242 705/500 |
| 2009/0173654 | A1 * | 7/2009 | Steenblik et al. | 206/459.5 |
| 2010/0090383 | A1 * | 4/2010 | Rawls-Meehan | A47C 7/027 267/145 |
| 2014/0090178 | A1 * | 4/2014 | Morgan et al. | 5/740 |

OTHER PUBLICATIONS

International Search Report and Written Opinion of the International Searching Authority for PCT/US2009/065638 mailed May 27, 2010.

* cited by examiner

SYSTEMS AND METHODS FOR MATTRESS ASSEMBLIES WITH ATTACHED CUSTOMER ASSISTANCE SENSORY DEVICES

CROSS-REFERENCE TO RELATED APPLICATIONS

This application claims the benefit of U.S. Provisional Patent Application No. 61/200,457, entitled "Systems and methods for mattress assemblies with attached customer assistance sensory devices" filed on Nov. 26, 2008, the entire disclosure of which is hereby incorporated by reference as if set forth herein in its entirety.

FIELD OF THE INVENTION

This invention relates to mattress assemblies with attached sensory devices, and more specifically, attached customer assistance sensory devices for furniture.

BACKGROUND OF THE INVENTION

Modern mattresses are manufactured to include many different technologies. For example, mattresses may incorporate a traditional or pocketed coil technology, or foams made form polyurethane or latex. Similarly, mattresses may include different types of mattress topper pads, side panels and additional upholstery and non-upholstery layers.

A consumer intending to purchase a new mattress may be intimidated by the different choices of mattress technology available. In addition, it may be difficult for a consumer in a showroom to determine the type of technology used in a particular mattress simply by looking at the mattress.

Accordingly, there is a need for a system that allows a consumer to be able to easily discern the technology used in a mattress. In addition, the consumer should easily be able to locate additional information about the technology in a particular mattress.

SUMMARY OF THE INVENTION

The systems and methods described herein are directed to mattress assemblies with attached customer assistance sensory devices, and more generally, customer assistance sensory devices for furniture. For purposes of clarity, and not by way of limitation, the systems and methods may be described herein in the context of providing customer assistance sensory devices for attachment to mattress assemblies. However, it may be understood that the systems and methods described herein may be applied to provide for any type of furniture. For example, the systems and methods of the invention may be used for beds, chairs, tables, desks, and other such furniture items.

More particularly, the mattress assembly with attached customer assistance sensory devices described herein include a mattress core with an attached headboard and a mattress cover that at least partially covers the mattress core. Customer assistance sensory devices may be attached directly or indirectly to one or more of the mattress core, headboard, and mattress cover. Optionally, the mattress assembly may include a mattress topper pad, a mattress sidewall, and a mattress foundation, all of which are attached to the mattress core. The mattress core may be of a type that comprises at least one of traditional coil, pocketed coil, memory foam, latex foam, viscoelastic, gel, water, and air.

The customer assistance sensory devices of the invention may present one or more parameters of the mattress core or mattress assembly to a user such as a customer or a retail worker. The customer assistance sensory devices may present this information via visual signals, audio signals, tactile signals, olfactory signals, or a combination thereof. Visual signals may comprise at least one of color, shape, pattern, text, or images. For example, a particular color may represent a particular parameter of the associated mattress core or assembly, such as the mattress core type. Audio signals may comprise at least one of music or speech. Tactile signals may comprise a texture or firmness. Olfactory signals may comprise one or more odors. The customer assistance sensory devices may be configured to provide these signals via a number of methods. For example, a customer assistance sensory device may comprise a colored banner with written text, an image, and a particular geometric shape. The color, text, image and shape each may represent one or more parameters of the mattress core or assembly.

In certain embodiments, the one or more parameters provided by the customer assistance sensory devices attached to one or more mattress cores or assemblies may allow for the efficient sorting and storage of mattress cores or assemblies. Alternatively, the one or more parameters provided by the customer assistance sensory devices may allow for easier and more efficient selection of a particular mattress or mattress type by a customer or a manufacturing/retailing worker.

In one embodiment, a method for manufacturing a mattress assembly is provided, wherein a headboard is attached to a mattress core, a mattress cover is used to at least partially cover the mattress core, and one or more customer assistance sensory devices are attached to at least one of the headboard, the mattress core, and the mattress cover.

BRIEF DESCRIPTION OF THE FIGURES

The foregoing and other objects and advantages of the invention will be appreciated more fully from the following further description thereof, with reference to the accompanying drawings wherein.

DETAILED DESCRIPTION

To provide an overall understanding of the invention, certain illustrative embodiments will now be described, including a mattress system with attached customer-assistance sensory devices that provide mattress core parameters. However, it will be understood by one of ordinary skill in the art that the systems and methods described herein may be adapted and modified for other suitable applications and that such other additions and modifications will not depart from the scope thereof.

In many aspects, the systems and methods described herein provide a mattress assembly with attached customer assistance sensory devices. The mattress assembly may include a mattress core, a headboard attached to one end of the mattress core, and/or a mattress cover at least partially enclosing the mattress core. At least one customer assistance sensory device may be attached to the mattress core, the headboard, or the mattress cover, or to some combination thereof. The at least one customer assistance sensory device may be configured to present one or more parameters relating to the mattress core or some other aspect or portion of the mattress assembly. The presentation of these parameters may aid the consumer in selecting an appropriate mattress. In addition, presenting these parameters may also allow improved storage and indexing capabilities at the manufacturer and retailer level, making it easier for workers or computer-aided systems to discern certain parameters of one or more mattresses and take appropriate action, such as storage or transport. In some embodiments, the customer assistance sensory device may be configured to dynamically or adaptively present these parameters to the consumers, workers, and/or computer-aided systems.

Figure 1:
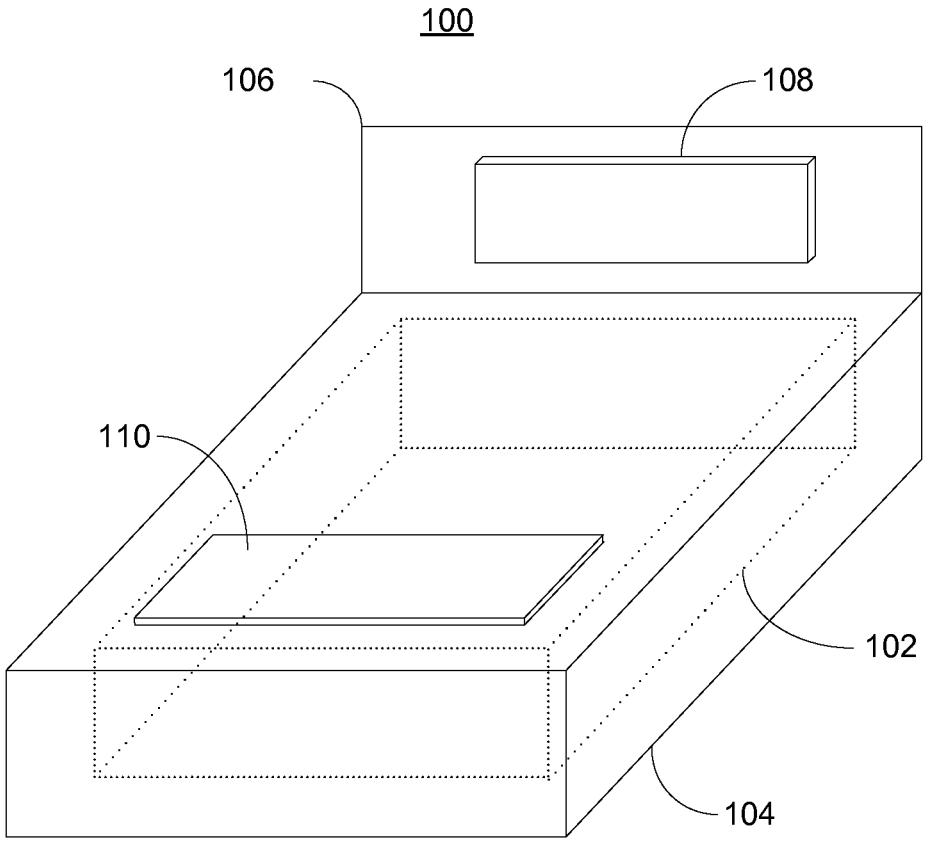
FIG. 1 depicts a mattress assembly, according to one illustrative embodiment of the invention.

FIG. 1 depicts a mattress assembly 100 according to an illustrative embodiment of the invention. Although the mattress assembly 100 is depicted as having a rectangular plan, it will be understood that the mattress assembly and its components may be sized and shaped as desired without departing from the scope of the invention. The mattress assembly 100 includes a mattress core 102, with an attached headboard 106. Mattress core 102 is further enclosed by a mattress cover 104. Although mattress cover 104 shown in FIG. 1 entirely encloses mattress core 102, in other embodiments the mattress cover 104 may only partially enclose mattress core 102. Optionally, a mattress topper pad, a mattress sidewall, and a mattress foundation may be attached to mattress core 102. A headboard customer assistance sensory device 108 is attached to headboard 106, and a mattress cover customer assistance sensory device 110 is attached to mattress cover 104.

The mattress core 102 may include an innerspring mattress comprising coils, or encased coils. Optionally, mattress core 102 may include polyurethane materials such as polyurethane foam, visco-elastic foam, latex foam, gel, and/or any suitable combination thereof. Alternatively, mattress core 102 may comprise one or more fluid-filled bladders, wherein the fluid may include air, water, gel, or any other suitable fluid medium.

The mattress assembly headboard 106 may be formed of a suitably rigid material, such as wood or wood composite, plastic, metal, foam, or some combination thereof. Alternatively, headboard 106 may be formed of a flexible material such as fabric, paper, or thin plastic, and may have other attachment points separate from the mattress assembly that maintain the headboard in a position substantially perpendicular to the surface on which mattress assembly 100 rests. Headboard 106 is attached to a sidewall of mattress core 102, and may be disposed parallel to that sidewall. Headboard 106 preferably has a larger area than the sidewall it is attached to, and may be configured to extend vertically upward past the sidewall. In some embodiments, headboard 106 may also extend horizontally past the sidewall either on one or both ends of the sidewall. Headboard 106 may be attached to mattress core 102 either directly or indirectly, for example via stitching, adhesives, or some type of physical fastener.

The mattress cover 104 at least partially encloses the mattress core 102. Mattress cover 104 may be formed from a sheet of flexible material, such as fabric, felt, or polymer, a cotton, nylon, or polyester batting, or from a layer of foam, plastic, polymer, natural fiber, synthetic fiber, or any other material or a combination thereof.

Customer assistance sensory devices 108 and 110 may be attached to or disposed on or near headboard 106 and mattress cover 104, respectively. Sensory devices 108 and 110 are configured and positioned so as to be able to easily present information to a customer. Methods of presentation may include visual, audio, tactile, olfactory, or some combination thereof. Sensory devices 108 and 110 may include one or more distinct colors, with a single color or combination of colors representing a particular parameter or set of parameters associated with mattress core 102. For example, a substantially magenta color may be included on sensory devices 108 and 110 if mattress core 102 contains encased coil technology. Similarly, a substantially orange color may be included on sensory devices 108 and 110 if mattress core 102 contains memory foam comprising high-density polyurethane. In certain embodiments, if mattress core 102 contains technology corresponding to two or more colors, the two or more colors may be included on sensory devices 108 and 110. Alternatively, another color may be used to indicate that a combination of technologies are present in mattress core 102, such as a substantially dark blue. Sensory devices 108 and 110 may also utilize text, shapes, and/or graphic patterns to present mattress core 102 parameters. The text, shapes, and/or patterns may be in one or more colors corresponding to one or more mattress core parameters. Shapes may have forms corresponding to one or more mattress core parameters. For example, a traditional coil mattress may be represented as a coil-like shape. Graphic patterns may include crosshatching or a dot matrix, and may also form shapes.

Sensory devices 108 and 110 may also present information via non-visual methods. For example, sensory devices 108 and 110 may have one or more textures that correspond to one or more parameters of mattress core 102. Such textures may include a rough surface, geometrically patterned ridges or bumps, a glassy smooth surface, a silky smooth texture, or a tacky texture. Optionally, sensory devices 108 and 110 may vary in firmness according to mattress core parameters. For example, sensory devices 108 and 110 may have a gel-like, yielding texture if mattress core 102 incorporates gel technology. Similarly, if mattress core 102 includes latex foam technology, sensory devices 108 and 110 may have textures and tactile responses similar to latex foam.

Olfactory methods may also be used by sensory devices 108 and 110 to present information about mattress core 102 parameters. For example, sensory devices 108 and 110 may present a particular odor or combination of odors that represents a particular mattress core parameter. For example, if mattress core 102 is a traditional coil mattress, a floral odor may be presented.

In certain embodiments, sensory devices 108 and 110 may present information about mattress core 102 parameters via visuals and audio from electronic devices such as one or more LCD (Liquid Crystal Display) screens or speakers. Visual information presented by sensory devices 108 and 110 in this fashion may include one or more distinct colors that represent a particular parameter or set of parameters associated with mattress core 102, as discussed previously. Text and other graphics such as still images or videos relating to mattress core 102 parameters may also be presented. In embodiments incorporating audio speakers, voices, tones, or music may be used to represent mattress parameters and technology. In some embodiments, sensory devices 108 and 110 may include one or more radio frequency identification (RFID) tags. These RFID tags may be active or passive. Active RFID tags may broadcast electromagnetic identification signals constantly, according to a preset schedule, or when queried via, for example, an RFID tag reader. Active RFID tags may include a power source for powering the RFID tag, such as a battery pack. Passive RFID tags may only broadcast identification signals when responding to a query from an RFID tag reader.

In certain embodiments, the sensory devices 108 and 110 may be communicatively linked to a network, such as a store network or the Internet. In these embodiments, the sensory devices may be able to transmit or receive information from network servers. For example, the sensory devices may present information about non-physical parameters, such as information about user ratings of a particular mattress core type obtained from an online survey. Similarly, the sensory devices may be able to indicate the availability of a particular mattress core or core type to consumers viewing a web page associated with the store, the manufacturer, or the particular mattress core/core type. The sensory devices may be able to indicate the store location at which the mattress core may be found, or the location within the store where the mattress core may be found.

In some embodiments, the sensory devices 108 and 110 may present information dynamically. For example, the sensory devices 108 and 110 may indicate the number of currently available mattresses of that type. As consumers purchase mattresses of that type, the sensory devices may update the information dynamically. In certain embodiments, the sensory devices may also be interactive. For example, a consumer may be able to direct the sensory devices to display other parameters about the mattress core, such as user ratings, popularity, and other such information.

Sensory devices 108 and 110 may comprise flexible material such as fabric, plastic, polymer, paper, or any other material or a combination thereof. Alternatively, sensory devices 108 and 110 may comprise substantially rigid materials such as plastic, wood, metal, glass, or any other such material or a combination thereof. Colors and text used for visual presentation of mattress core 102 parameters may be incorporated into sensory devices 108 and 110 via a variety of methods. For example, colors may be printed, stamped, or painted upon the sensory device surface, or the colors may be incorporated integrally within the sensory device structure, as for example a sewn color pattern, an underlying layer with a transparent or translucent over-layer or suffused throughout at least part of the device structure. Text and shapes may be printed, stamped, painted, written, drawn, embossed, etched, sewn, or engraved upon the sensory device surface, or they may be integrally incorporated within the sensory device structure. Textures used for tactile presentation of parameters may be incorporated integrally into sensory devices 108 and 110, or may be present in one or more additional structures attached to sensory devices 108 or 110. These one or more structures may comprise fabric, wood, plastic, polymer, paper, glass, metal, or any such material. They may be attached to sensory devices 108 and 110 directly or indirectly, for example via stitching, adhesives, or another fastener, or may be integrally incorporated into the sensory devices. Odors used for olfactory presentation of mattress parameters may be produced by an odor-bearing material integrally built into sensory devices 108 or 110 or by a separate structure attached to sensory devices 108 or 110 that contains odor-bearing material or is capable of generating one or more odors. In certain embodiments, sensory devices 108 and 110 may comprise electronic devices for information presentation such as LCD screens or audio speakers. These devices may optionally be based on flexible or fabric-based electronic devices. The sensory devices 108 and 110 are depicted as being substantially rectangular in FIG. 1, but may be sized and shaped as desired without departing from the scope of the invention. In particular, sensory devices 108 and 110 may be formed into a geometric shape such as a triangle, circle, square, trapezoid, or any such geometric shape or combination thereof.

Sensory devices 108 and 110 may be integrally built into headboard 106, mattress cover 104, or mattress core 102. In certain embodiments, sensory devices 108 and 110 may be individual structures attached to headboard 106, mattress 104, or mattress core 102. The sensory devices may be attached directly or indirectly, for example by stitching, adhesives, or a physical fastener or linker.

Sensory devices 108 and 110 may be configured to present information representing one or more parameters of mattress core 102. For example, information presented may include type of mattress core, technology incorporated into the mattress core, materials used to construct the mattress core, test data related to the mattress core, reviews of the mattress core, or any such information or advertising related to mattress core 102. The information presented by sensory devices 108 and 110 need not be limited to parameters associated with mattress core 102. Sensory devices 108 and 110 may be used to present information about the mattress cover 104 or any other bedding or mattress component, such as mattress topper pads, mattress sidewalls, mattress foundations, bedsheets, pillows, blankets, quilts, or other such furnishings. For all of the above embodiments, sensory devices 108 and 110 may be configured to present different information via different presentation methods. For example, sensory device 110 may present information about mattress core 102 via color, and sensory device 108 may present information about mattress core 102 via color and text. In another embodiment, sensory device 110 may present mattress core 102 information via texture, and sensory device 108 may use an LCD screen to display information about mattress core 102. In embodiments containing one or more LCD screens, the LCD screens may be touch-sensitive, allowing a customer to request additional information regarding the mattress core 102 or mattress assembly 100 via touchscreen input.

Figure 2:
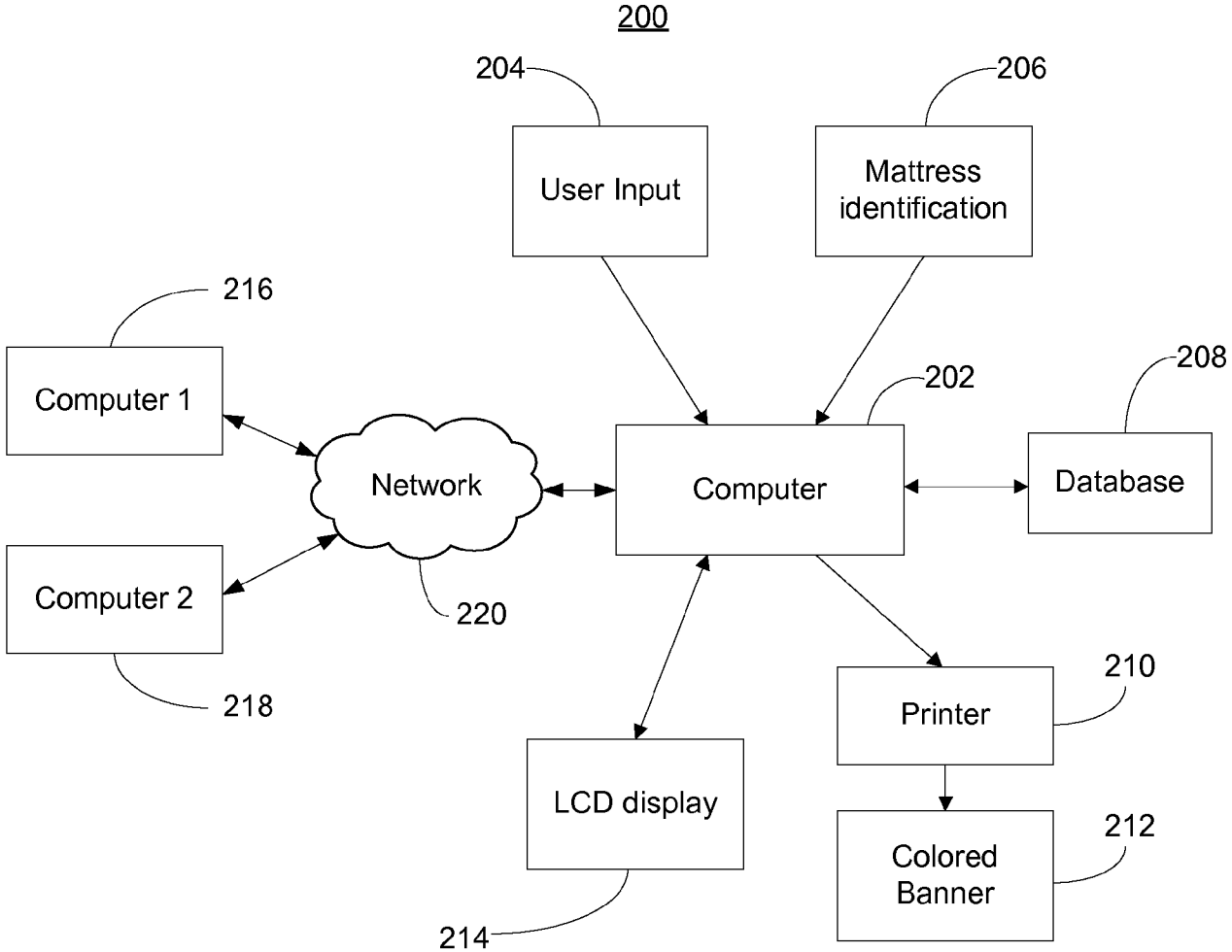
FIG. 2 is a block diagram depicting a system for the production and maintenance of a mattress assembly sensory device, according to one illustrative embodiment of the invention.

FIG. 2 depicts a block diagram of an exemplary system 200 for the production and maintenance of mattress assembly sensory devices. When sensory devices are to be placed on one or more mattress assemblies, a computer 202 gathers data relating to one or more parameters of the mattress cores in the mattress assemblies. This data may be gathered from a manufacturer or retail worker from user input 204, a mattress identification database 206, or a second database 208. Optionally, one or more computers 202 may gather mattress information from networked computers 216 and 218. Using the gathered mattress parameter information, computer 202 may either take steps to produce a sensory device or to update a preexisting sensory device.

In one embodiment, the computer 202 may configure a printer 210 to produce a colored banner sensory device 212. Colored banner sensory device 212 may have one or more distinct colors or color combinations that represent one or more parameters of a mattress core. Banner sensory device 212 may also have printed text that present information regarding one or more parameters of the mattress core. Banner sensory device 212 may have a particular geometric shape, and in some embodiments this shape may correspond to one or more parameters of the mattress core. Once printed, banner sensory device 212 may be attached directly or indirectly to the mattress core, headboard, or mattress cover of a mattress assembly.

In certain embodiments, the one or more sensory devices attached to mattress assembly 100 comprise an electronic presentation device such as an LCD display 214. In these cases, computer 202 may update the information displayed on the LCD display 214, such as colors, shapes or text. In embodiments where LCD screen 214 is touch-sensitive, computer 202 may also be configured to receive information from LCD screen 214. The computer 202 may be directly connected to the LCD display 214, or may be connected to the LCD display 214 via a network.

Computer 202 may store information related to the banner sensory device 212, LCD display device 214, or the mattress core or assembly associated with those devices in database 208. Computer 202 may also communicate this information to computers 216 and 218, for example through network 220. Network 220 may include a local are network, wide area network, or the Internet.

Computer 202 may include a central processing unit (CPU), a memory, and an interconnect bus. The CPU may include a single microprocessor or a plurality of microprocessors for configuring computer 202 as a multi-processor system. The memory may include a main memory and a read only memory. The computer 202 may also include a mass storage device having, for example, various disk drives, tape drives, FLASH drives, etc. The main memory also includes dynamic random access memory (DRAM) and high-speed cache memory. In operation, the main memory stores at least portions of instructions and data for execution by the CPU.

The mass storage may include one or more magnetic disk or tape drives or optical disk drives, for storing data and instructions for use by the CPU. In certain embodiments, at least one component of the mass storage system, preferably in the form of a disk drive or tape drive, may store a database. The mass storage system may also include one or more drives for various portable media, such as a floppy disk, a compact disc read only memory (CD-ROM), DVD, or an integrated circuit non-volatile memory adapter (i.e. PC-MCIA adapter) to input and output data and code to and from the computer 202.

The computer 202 may also include one or more input/output interfaces for communications. This interface may comprise one or more of a modem, a network card, serial port, bus adapter, or any other suitable data communications mechanism. Computer 202 may also communicate with computers 216 and 218 via, for example, optical, wired, or wireless methods (e.g., via satellite or cellular network).

Figure 3:
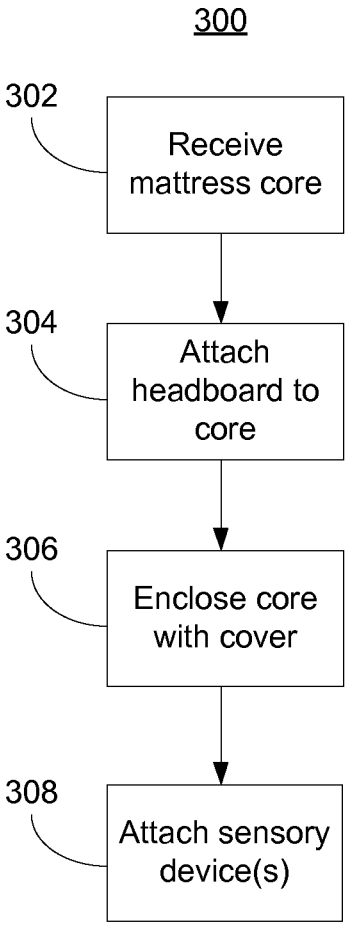
FIG. 3 is a flowchart depicting a process for producing a mattress assembly with sensory devices, according to an illustrative embodiment of the invention.

FIG. 3 depicts a process 300 for producing a mattress assembly with sensory devices, according to an illustrative embodiment of the invention. The process 300 begins at step 302, where a mattress core similar to mattress core 102, described above with relation to FIG. 1, is received. In step 304, a headboard, similar to headboard 106 described above in relation to FIG. 1, is attached to the mattress core. The headboard may be attached to the mattress core either directly or indirectly. For example, the headboard may be attached to the mattress via stitching, adhesives, and/or one or more physical fasteners. In some embodiments, the headboard may be attached to an interposing structure, which is then attached to the mattress core. In step 306, the mattress core is at least partially enclosed with a mattress cover similar to mattress cover 104 (FIG. 1). The mattress cover may be configured to attach directly to the mattress core, or merely to cover at least part of the mattress core. Finally, in step 308, one or more sensory devices are attached to the mattress assembly, via stitching, adhesives, and/or one or more physical fasteners. The one or more sensory devices may be similar to headboard sensory device 108 and/or mattress cover sensory device 110 (FIG. 1), and provides one or more parameters about the mattress assembly, the mattress core, the headboard, and/or the mattress cover.

Figure 4:
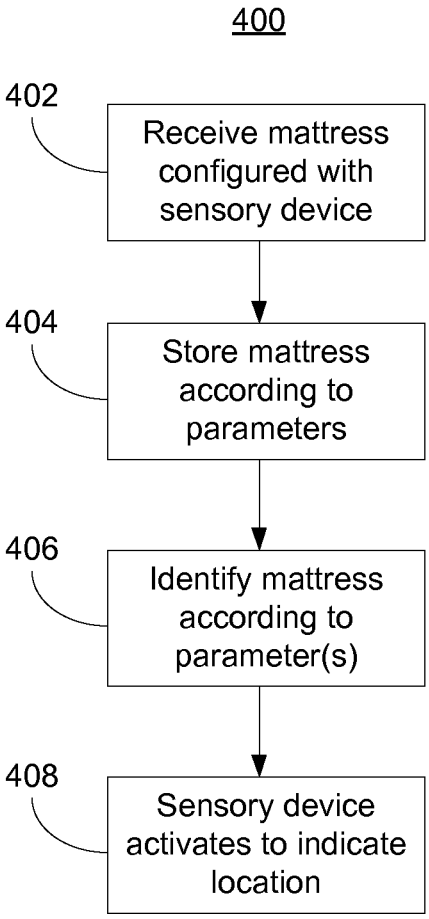
FIG. 4 is a flowchart depicting a process for identifying a stored mattress assembly with sensory devices, according to an illustrative embodiment of the invention.

FIG. 4 is a flowchart depicting a process 400 for identifying a stored mattress assembly with sensory devices, according to an illustrative embodiment of the invention. In step 402, a mattress assembly configured with one or more sensory devices is received. The mattress assembly is then stored in step 404 according to one or more mattress assembly parameters, which may be indicated by the one or more sensory devices. For example, certain types of mattress assemblies may be stored together, for ease of organization. As another example, a particular type of mattress may have a preferred orientation for storage, such as vertical or horizontal, to prevent degradation of mattress properties. In some embodiments, the sensory devices may indicate the storage location and characteristics of the mattress assembly to a manual or automatic handler, for example via an RFID tag, a displayed barcode, a displayed graphic, or displayed text.

After the mattress assembly has been stored, at some point it may be necessary to identify the mattress assembly and its location (step 406). For example, a customer may order a particular type of mattress with parameters that match the mattress assembly. In one embodiment, the mattress assembly may be identified by its storage location. In step 404, the mattress assembly was stored according to parameters indicated by the sensory devices, and by searching in the physical location corresponding to those parameters. In other embodiments, the sensory devices may activate to indicate the location of the mattress assembly (step 408). For example, the sensory devices may emit radiation or an audio signal to enable a handler to find the mattress assembly. In some embodiments, the sensory devices may include an active or passive RFID tag that broadcasts identification information for the mattress assembly.

Variations, modifications, and other implementations of what is described may be employed without departing from the spirit and scope of the invention. More specifically, any of the method, system, and device features described above or incorporated by reference may be combined with any other suitable method, system, or device features disclosed herein or incorporated by reference, and is within the scope of the contemplated inventions. The systems and methods may be embodied in other specific forms without departing from the spirit or essential characteristics thereof. The foregoing embodiments are therefore to be considered in all respects illustrative, rather than limiting of the invention. The teachings of all references cited herein are hereby incorporated by reference in their entirety.

The invention claimed is:

1. A mattress assembly comprising:

a mattress core;

a headboard attached to the mattress core, wherein the headboard is attached to a mattress sidewall of the mattress core and extends vertically upwards parallel to the mattress sidewall; and a mattress cover at least partially enclosing the core, wherein an outermost surface of at least one of the mattress core, the mattress cover, and the headboard is configured with a customer assistance sensory device configured to provide to a customer an odor indicative of one or more parameters of the mattress core, wherein the customer assistance sensory device consists of a member physically attached to the outermost surface of at least one of the mattress core, the mattress cover, and the headboard, wherein the member includes a top surface that is parallel to the outermost surface, and wherein the top surface of the customer sensory assistance device provides to the customer the odor indicative of the one or more parameters of the mattress core and is viewable by an end user from a foot end of the mattress assembly.

2. The mattress assembly of claim 1, wherein the mattress core type comprises at least one of traditional coil, pocketed coil, memory foam, latex foam, viscoelastic, gel, water, and air.

3. The mattress assembly of claim 1, further comprising at least one of a mattress topper pad attached to the mattress core and a mattress foundation attached to the mattress core.

4. The mattress assembly of claim 3, wherein the customer assistance sensory device is further configured to provide to the customer one or more parameters of at least one of the mattress topper pad, the mattress sidewall, and the mattress foundation.

5. The mattress assembly of claim 1, wherein the sensory device is physically attached via stitching.

6. The mattress assembly of claim 1, wherein the sensory device is physically attached via a fastener.

7. The mattress assembly of claim 1, wherein the sensory device is physically attached via an adhesive.

8. The mattress assembly of claim 1, wherein the member is a textured material.

9. The mattress assembly of claim 1, wherein the sensory device is configured in a substantially geometric shape.

10. The mattress assembly of claim 1, wherein the headboard comprises the customer sensory device.

11. A mattress assembly comprising:

a mattress core;

a headboard;

a mattress cover at least partially enclosing the core, wherein an outermost surface of at least one of the mattress core, the mattress cover, and the headboard is configured with a customer assistance sensory device configured to provide to a customer an odor indicative of one or more parameters of the mattress core, wherein the customer assistance sensory device consists of a member physically attached to the outermost surface of at least one of the mattress core, the mattress cover, and the headboard, wherein the member includes a top surface that is parallel to the outermost surface, and wherein the top surface of the customer sensory assistance device provides to the customer the odor indicative of the one or more parameters of the mattress core and is viewable by an end user from a foot end of the mattress assembly.

* * * * *